US006417137B1

(12) United States Patent
Suzaki et al.

(10) Patent No.: US 6,417,137 B1
(45) Date of Patent: Jul. 9, 2002

(54) TRANSPARENT THERMOSENSITIVE RECORDING MATERIAL

(75) Inventors: Hideo Suzaki; Hitoshi Shimbo, both of Shizuoka (JP)

(73) Assignee: Ricoh Company Ltd., Tokyo (JP)

( * ) Notice: Subject to any disclaimer, the term of this patent is extended or adjusted under 35 U.S.C. 154(b) by 41 days.

(21) Appl. No.: 09/689,154

(22) Filed: Oct. 12, 2000

(30) Foreign Application Priority Data

Oct. 14, 1999 (JP) ..... 11-292991
Sep. 28, 2000 (JP) ..... 2000-295599

(51) Int. Cl.[7] ..... B41M 5/28
(52) U.S. Cl. ..... 503/200; 503/221; 503/225; 503/226
(58) Field of Search ..... 503/200, 201, 503/225, 226

(56) References Cited

U.S. PATENT DOCUMENTS 5,407,890 A * 4/1995 Ishikawa ..... 503/201

* cited by examiner

*Primary Examiner*—Bruce H. Hess
(74) *Attorney, Agent, or Firm*—Cooper & Dunham LLP

(57) ABSTRACT

A transparent thermosensitive recording material capable of producing an image therein has a transparent support and a thermosensitive recording layer formed thereon, the recording layer containing a colorless or light-colored leuco dye, a color developer capable of inducing coloring formation in the leuco dye, and a binder resin. The image obtained in the recording material exhibits an absorbance of 3.0 or more at 610 nm when the image has a maximum transmission density, and the ratio of the absorbance at 700 nm to the absorbance at 610 nm is in a range of 0.1 to 0.3 within the region from a transmission density of the image of 1.0 to the maximum transmission density thereof.

20 Claims, 3 Drawing Sheets

TRANSPARENT THERMOSENSITIVE RECORDING MATERIAL

BACKGROUND OF THE INVENTION

1. Field of the Invention

The present invention relates to a transparent thermosensitive recording medium suitable for medical applications, and more particularly to a transparent thermosensitive recording material useful as an image formation sheet capable of producing an image therein with excellent light shielding properties and black coloring performance when viewed on a film viewer called "Schaukasten", and in addition, with excellent image preservation stability.

2. Discussion of Background

Various kinds of recording materials employing the process of thermosensitive coloring reaction are proposed. Such a thermosensitive recording material is generally prepared by coating a mixture of a coloring agent such as a dye, and a color developer on the surface of paper.

In particular, the thermosensitive recording material employing the coloring reaction of a leuco dye has the following advantages:

(a) This type of thermosensitive recording material is prepared by coating a coating liquid comprising a colorless dye precursor and a color developer on a support. When heat is imagewise applied to the thermosensitive recording material, the dye precursor and the color developer dispersed in the form of particles on the support are fused and mixed to cause a coloring reaction. Different from other recording systems such as ink jet printing and thermal image transfer recording, image recording can be achieved by supplying only a thermosensitive recording material. This will be hereinafter referred to as a one-supply system.

(b) When a leuco dye causes a coloring reaction of a black color, the leuco dye shows two broad absorption peaks in the visible region, the two peaks being equal. Therefore, the obtained absorption spectrum becomes flat, so that a black color image can be obtained by use of one kind of leuco dye.

(c) Unlike other recording systems, a recording apparatus for the leuco-type thermosensitive recording material can be made compact by virtue of the fact that the recording can be achieved by the one-supply system, and the recording sensitivity is high.

In light of the above-mentioned advantages, the leuco-type thermosensitive recording material is widely used, for example, as a recording material for facsimile machine, a label for indicating information which is attached to the package of food, and a two-valued character information bearing recording medium for use with delivery management system.

However, the leuco-type thermosensitive recording material has the drawbacks that the background portion tends to cause yellowing and the image portion tends to cause decolorization due to the exposure to heat, light, moisture, and plasticizers. Namely, the preservation stability of the leuco-type thermosensitive recording material is insufficient.

In recent years, disposal of the waste liquid caused by the wet-type image formation process for a silver salt X-ray film has become a serious problem in the medical field. Further, in line with the trend toward the formation of digital image, there is an increasing demand for a dry image formation process using a transparent film capable of easily producing an image therein.

The dry process currently employed in the medical field is divided into the following three systems: (1) light-exposing and heat-fixing system, (2) thermal transfer system, and (3) direct thermosensitive recording system. Among the above-mentioned dry-type systems, the direct thermosensitive recording system (3) attracts special attention because the image formation system is remarkably simple. Namely, image formation can be achieved by the above-mentioned one-supply system, and only a development unit will do for achieving image recording.

Under such circumstances, there is a great demand for a leuco-type thermosensitive recording material not only as the conventional recording medium capable of producing reflection type two-valued character information, but also as a transparent recording medium capable of producing an image with a gray scale, similar to the conventional silver salt film as can be employed in the medical field.

A transmission type image produced in the above-mentioned transparent recording medium for medical applications is expected to satisfy the following requirements: (1) satisfactory light shielding properties and color tone when the image is viewed on the film viewer, (2) sufficient transparency, (3) excellent gradation in color, and (4) high preservation stability. The color gradation (3) of the image depends upon both the recording medium and the recording system therefor. The requirements (1), (2), and (4) are to be controlled by the recording medium itself.

To be more specific, when the leuco-type thermosensitive recording medium is used for medical applications, that is, when the image formed in the transparent thermosensitive recording medium is viewed on the film viewer using transmitted light, there are the following problems.

First of all, when the transmitted light is used, it is difficult for one black coloring leuco dye to produce a black color with satisfactory coloring performance.

FIG. 1 shows absorption spectra of one of the representative leuco dyes capable of producing a black color, using reflecting light and transmitted light. When the transmitted light is used, the black coloring leuco dye exhibits absorption peaks as shown in FIG. 1, and the absorption is decreasing in the near infrared region. The result is that satisfactory black color cannot be produced by use of a single leuco dye. In contrast to this, when the reflected light is used, a satisfactory black color can be produced only by a single leuco dye.

Further, in order to improve diagnostic accuracy, the image formed in the recording material is required to have sufficient light shielding properties when the image is viewed on the film viewer.

The last problem is that not only an image portion with a high transmission density, but also the whole images with different transmission densities are required to have improved preservation stability.

Japanese Patent No. 2773539 discloses a method for obtaining a predetermined black color tone on a reflection type thermosensitive recording material. For adjustment of color tone of the obtained image, a mixture of leuco dyes is removed. To be more specific, a leuco dye capable of producing a black color is used in combination with leuco dyes capable of producing blue and red colors, with the melting points of the blue and red coloring leuco dyes being higher than that of the black coloring leuco dye. When this kind of reflection thermosensitive recording material is applied to the formation of transmission type images, the obtained black color image is not provided with satisfactory color tone, nor sufficient light shielding properties.

Japanese Laid-Open Patent Application No. 08-156430 proposes a method for producing a black color image in a transparent sheet not only by use of a medical film viewer, but also by daylight. However, when a transparent recording sheet is prepared by the coating method using the same leuco dye and color developer as used in the above-mentioned application, the preservation stability of images formed in the recording sheet becomes poor. In addition, the light shielding properties of the image are insufficient when the image is viewed on a medical film viewer.

SUMMARY OF THE INVENTION

Accordingly, an object of the present invention is to provide a transparent thermosensitive recording material capable of producing high quality images, in particular, medical images for diagnostic use which are viewed on a film viewer, that is, "Schaukasten", with sufficient light shielding properties, excellent black color tone, and high preservation stability.

The above-mentioned object of the present invention can be achieved by a transparent thermosensitive recording material capable of producing an image therein, comprising a transparent support and a thermosensitive recording layer formed thereon comprising a colorless or light-colored leuco dye, a color developer capable of inducing coloring formation in the leuco dye, and a binder resin, wherein the image formed in the recording material exhibits an absorbance of 3.0 or more at 610 nm when the image has a maximum transmission density, and the ratio of the absorbance at 700 nm to the absorbance at 610 nm is in a range of 0.1 to 0.3 within the region from a transmission density of the image of 1.0 to the maximum transmission density thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
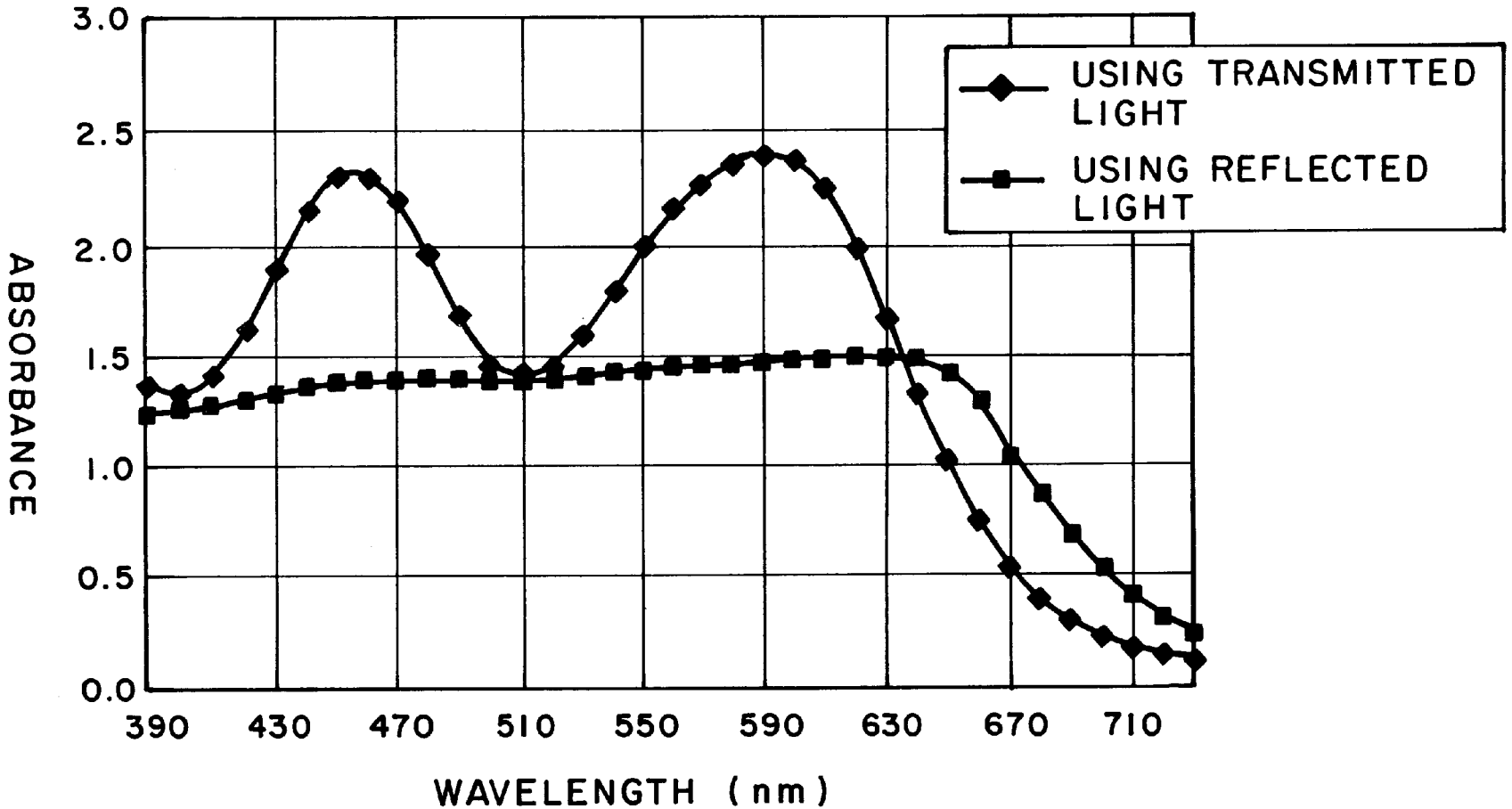
FIG. 1 shows absorption spectra of one of representative black coloring leuco dyes, each being obtained using transmitted light or reflected light.
Figure 2:
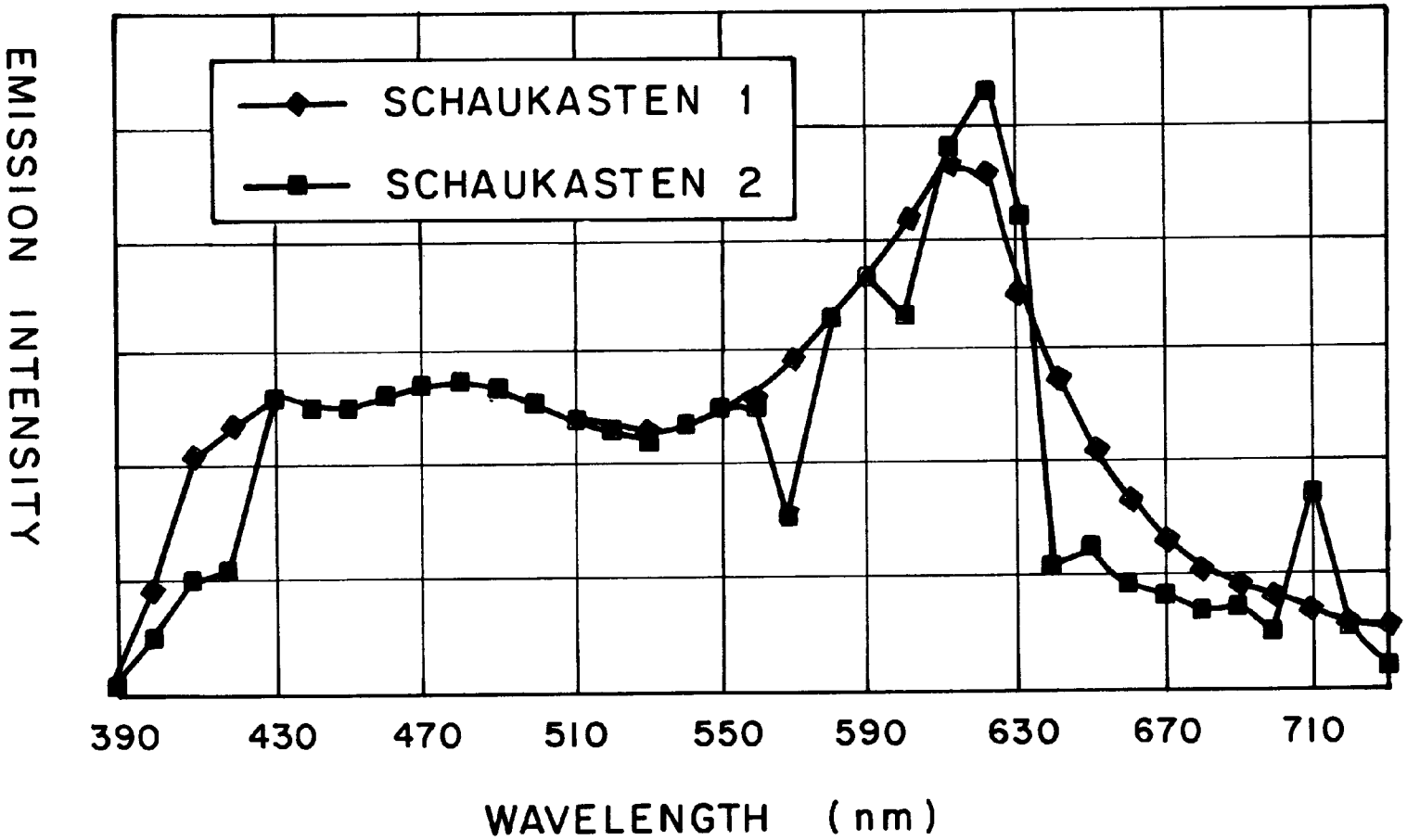
FIG. 2 shows emission spectra of light sources used in typical light viewers for medical use, that is, "Schaukasten".

FIG. 2 shows emission spectra of two types of typical film viewers, Schaukasten 1 and Schaukasten 2. As is apparent from FIG. 2, strong emission exists within a range of 410 to 650 nm, in particular within a range of 590 to 630 nm. Also, there exists emission, although it is weak, within a range of 650 to 700 nm.

Accordingly, an image formed in the transparent thermosensitive recording material is required to exhibit an absorption within a wavelength range of 590 to 630 nm to ensure excellent light shielding properties on the film viewer for medical use. Further, when the transmitted light is used, the image formed in the transparent thermosensitive recording material is required to show an absorption within a wavelength range of 650 to 700 nm in light of a black coloring performance.

In view of light leakage on the film viewer, light shielding can be efficiently attained when the image produced in the transparent thermosensitive recording material can exhibit strong absorption in the wavelength range corresponding to the strong emission of the film viewer.

The light absorptivity per molecule of a leuco dye capable of producing a black color (which is hereinafter referred to as a black coloring leuco dye) is usually higher when compared with leuco dyes for producing other colors than black. It is commonly known that the black coloring leuco dye provides better image preservation stability under various conditions of temperature and humidity than the other leuco dyes.

When the transmitted light is used, a single black coloring leuco dye cannot satisfactory provide excellent coloring performance, i.e., a black color is tinged with other colors, although satisfactory light shielding properties can be obtained.

As mentioned above, the blue and red coloring leuco dyes are mixed with the black coloring leuco dye for adjustment of color tone of the obtained image in the conventional reflection thermosensitive recording material. In the case where the transmitted light is used for observation of the image, such mixed leuco dyes can improve the color tone to some extent at lower transmission densities, but cannot provide a black color not tinged with other colors at medium to higher transmission densities.

In view of the above, it is preferable that at least three leuco dye components be mixed in the transparent thermosensitive recording material of the present invention for obtaining both satisfactory light shielding properties and excellent black coloring performance not tinged with other colors when the obtained image is observed on the film viewer using transmitted light. In particular, it is preferable that a leuco dye component exhibiting a maximum absorption peak in the wavelength range of 400 to 580 nm, and a leuco dye component exhibiting a maximum absorption peak in the wavelength range of 630 to 750 nm be added to the black coloring leuco dye to provide excellent black color tone when the obtained image is viewed using transmitted light.

In this case, however, the three leuco dye components are mixed so as to satisfy the following conditions. Namely, an image portion with a maximum transmission density formed in the transparent thermosensitive recording material exhibits an absorbance of 3.0 or more at 610 nm, and the ratio of the absorbance at 700 nm to the absorbance at 610 nm is in a range of 0.1 to 0.3 within the region from a transmission density of 1.0 to the maximum transmission density. It is found that when the above-mentioned conditions are satisfied, light shielding properties and black coloring performance of the image formed in the transparent thermosensitive recording material are acceptable for practical use, and at the same time, the image preservative stability is excellent.

In the case where the image portion with a maximum transmission density exhibits an absorbance of less than 3.0 at 610 nm, the light shielding properties of a solid black image are lowered on the film viewer. In the case where the ratio of the absorbance at 700 nm to the absorbance at 610 nm is less than 0.1 within the region from a transmission density of 1.0 to the maximum transmission density, excellent black coloring performance cannot be attained at any transmission densities when the image is viewed on the film viewer. When the above-mentioned ratio exceeds 0.3, the content of the black coloring dye component is relatively decreased. As a result, it becomes difficult for the image portion with a maximum transmission density to exhibit an absorbance of 3.0 or more at 610 nm. Further, the image preservation stability becomes unfavorably poor.

In the context of the present invention, the absorbance at wavelength of 610 nm is given as an indication of the light shielding properties of the image on the film viewer, while the absorbance at wavelength of 700 nm is given as an indication of black coloring performance of images with transmission densities of 1.0 or more.

The materials for use in the transparent thermosensitive recording material of the present invention will now be explained in detail.

Examples of the materials for the transparent support are polyesters such as polyethylene terephthalate and polybutylene terephthalate; cellulose derivatives such as cellulose triacetate; polyolefin such as polypropylene and polyethylene; polyethylene naphthalate; and polystyrene. These resin films may be laminated to prepare a transparent support.

The transparency of the support affects the transparency of the whole recording material. It is preferable that the transparent support have a haze of 10% or less. The haze is an indication of transparency defined by JIS K7105, and is determined by integrating sphere type light transmittance measurement in accordance with the following equation: H [Haze value (%)]=Td/Tt×100, wherein Td is diffuse transmittance, and Tt is total light transmittance. The greater the haze value, the less transparent the support is.

In the present invention, a polyethylene terephthalate film is the most preferable transparent support from the viewpoints of manufacturing cost, heat resistance, and other properties.

For accurate medical diagnosis using images formed in the transparent thermosensitive recording material by transmitted light, the haze of the transparent thermosensitive recording material is preferably 40% or less. In this case, the image recognition performance can be remarkably improved when the image is observed on the medical film viewer because image clearness is excellent.

For the purpose of obtaining glare protection effect and improving the image recognition performance, the transparent thermosensitive recording material of the present invention may be blue-colored. The glare protection effect is particularly important with respect to strong light emission of the film viewer (Schaukasten), within a wavelength range of 590 to 630 nm. The transparent support itself may be blue-colored, or at least one layer formed by coating may be subjected to bluing.

The bluing process is performed in such a manner that when the transmission density of an image is within the range of 0.15 to 0.25, the color tone of the image may be represented by the particular CIE L*a*b* color space. Namely, it is preferable that the color tone be determined in such a way that one of the chromaticness indices a* is in the range of −4 to −12, and another chromaticness index b* is in the range of −5 to −15.

The above perceived color space is measured using the standard illuminant $D_{65}$ of diffuse/specular (d/0) light under the conditions that the standard observer is set at $10^{0}$ and the physical resolution is set at 10 nm.

The thermosensitive recording layer for use in the present invention comprises a colorless or light-colored leuco dye, a color developer for inducing coloring formation in the leuco dye by the application of heat, and a binder resin.

The leuco dye for use in the present invention is an electron-donating dye precursor. The conventional leuco dyes can be used alone or in combination. Preferable examples of the leuco dye for use in the present invention include a triphenylmethane phthalide leuco compound, a triallylmethane leuco compound, a fluoran leuco compound, a phenothiazine leuco compound, a thiofluoran leuco compound, a xanthene leuco compound, an indophthalyl leuco compound, a spiropyran leuco compound, an azaphthalide leuco compound, a couromeno-pyrazole leuco compound, a methine leuco compound, a rhodamine anilinolactam leuco compound, a rhodamine lactam leuco compound, a quinazoline leuco compound, a diazaxanthene leuco compound, and a bislactone leuco compound.

For achieving the object of the present invention, it is preferable to adjust the absorption spectrum by employing a black coloring leuco dye component together with leuco dye components capable of producing other colors than black. More specifically, it is preferable that a leuco dye component exhibiting a maximum absorption peak within a range of 400 to 580 nm, and a leuco dye component exhibiting a maximum absorption peak within a range of 630 to 750 nm be used in combination with the black coloring leuco dye component. With the image preservation stability taken into consideration, it is preferable that the content of the black coloring leuco dye component be 60 wt. % or more of the total weight of the leuco dye components.

The fluoran leuco compound is preferred in the present invention as the black coloring leuco dye component. Specific examples of the fluoran leuco compounds are as follows:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-ethylamino) fluoran, 2-anilino-3-methyl-6-(N-n-amyl-N-ethylamino)fluoran, 2-anilino-3-methyl-6-(N-isoamyl-N-ethylamino)fluoran, 2-anilino-3-methyl-6-(N-n-propyl-N-isopropylamino) fluoran, 2-anilino-3-methyl-6-(N-cyclohexyl-N-methylamino) fluoran, 2-anilino-3-methyl-6-(N-ethyl-p-toluidino)fluoran, and 2-anilino-3-methyl-6-(N-methyl-p-toluidino)fluoran.

Those black coloring leuco dye components may be used alone or in combination.

Specific examples of the leuco dye component exhibiting a maximum absorption peak within a range of 400 to 580 nm include rhodamine-B-o-chloroanilinolactam, 3,6-bis (diethylamino)fluoran-γ-(4'-nitro)anilinolactam, 1,3-dimethyl-6-diethylaminofluoran, and 6-diethylamino-7,8-benzofluoran. Specific examples of the leuco dye component exhibiting a maximum absorption peak within a range of 630 to 750 nm include 6-diethylamino-2-ethylbenzo[1,4] thiazino[3,2-b]fluoran, 3,3-bis(4-diethylamino-2-ethoxyphenyl)-4-azaphthalide, and 3-[2,2-bis(1-ethyl-2-methyl-3-indolyl)vinyl]-3-(4-diethylaminopheny)phthalide.

In the present invention, a color developer represented by formula (1) is preferably used, which will be described later in detail. When the color developer of formula (1) is employed, it is preferable to employ the combination of, for instance, 2-anilino-3-methyl-6-diethylaminofluoran as the black coloring leuco dye component, 6-diethylamino-7,8-benzofluoran or 1,3-dimethyl-6-diethylaminofluoran as the leuco dye component exhibiting a maximum absorption peak in 400 to 580 nm, and 6-diethylamino-2-ethylbenzo[1,4]thiazino[3,2-b]fluoran as the leuco dye component exhibiting a maximum absorption peak in 630 to 750 nm, which is represented by the following formula (2):

(2)

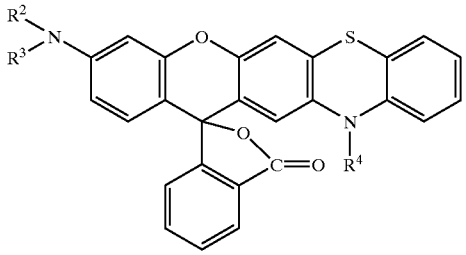

wherein $R^2$ and $R^3$ are each independently a straight-chain or branched alkyl group having 1 to 6 carbon atoms, an alkoxyalkyl group having 2 to 6 carbon atoms, a cycloalkyl group having 5 or 6 carbon atoms, allyl group, or

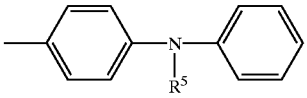

in which $R^5$ is an alkyl group having 1 to 5 carbon atoms, and $R^2$ and $R^3$ may form a 5- or 6-membered heterocyclic ring in combination; and $R^4$ is a hydrogen atom, or a straight-chain or branched alkyl group having 1 to 12 carbon atoms.

The above-mentioned combination can provide the transparent thermosensitive recording material having excellent coloring performance and preservation stability.

The color developer for use in the thermosensitive recording layer is an electron-accepting compound capable of inducing color formation in the above-mentioned leuco dyes. A variety of conventional electron-accepting color developers can be employed in the present invention. In particular, an electron-accepting color developer having a long-chain alkyl group in its molecule is preferably used as the color developer, which is disclosed in Japanese Laid-Open Patent Application 5-124360. For instance, there can be employed an organic phosphoric acid compound, an aliphatic carboxylic acid compound, and a phenol compound, each having an aliphatic group with 12 or more carbon atoms; a metallic salt of mercaptoacetic acid having an aliphatic group with 10 to 18 carbon atoms; an alkyl ester of caffeic acid having an alkyl group with 5 to 8 carbon atoms; and an acid phosphate having an aliphatic group with 16 or more carbon atoms. The above-mentioned aliphatic group includes a straight-chain or branched alkyl group or alkenyl group, which may have a substituent such as a halogen atom, an alkoxyl group, or an ester group.

A preferred color developer is an organic phosphoric acid compound represented by the following formula (1):

(1)

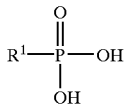

wherein $R^1$ is a straight-chain alkyl group having 12 to 28 carbon atoms.

By use of the organic phosphoric acid compound of formula (1), transparency of the recording material can be ensured, fogging of the background can be minimized, and preservation stability of the image can be improved.

Specific examples of the organic phosphoric acid compounds represented by formula (1) are as follows: dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, and octacosylphosphonic acid.

The color developer for use in the present invention is not limited to the compounds described above, but may be selected from a wide variety of electron-accepting compounds such as a phenolic color developer, i.e., 4,4'-isopropylidenebisphenol or 4,4'-isopropylidenebis(o-methylphenol); a salicylic acid color developer; a carboxylic acid color developer; and a metallic salt color developer.

Those color developers may be used alone, or in combination. It is preferable that the color developer for use in the thermosensitive recording layer be in an amount of 1 to 20 parts by weight, more preferably 2 to 10 parts by weight, to one part by weight of the leuco dye.

A variety of conventional binder resins are usable for the thermosensitive recording layer. Specific examples of the binder resins are polyacrylamide, maleic acid copolymer, polyacrylate, polymethacrylate, vinyl chloride-vinyl acetate copolymer, styrene copolymer, polyester, polyurethane, poly(vinyl butyral), ethyl cellulose, poly(vinyl acetal), poly(vinyl acetoacetal), polycarbonate, epoxy resin, and polyamide. In light of transparency, it is preferable that the ratio of the refractive index of the binder resin for use in the thermosensitive recording layer to that of the transparent support be in a range of 0.8 to 1.2.

When the above-mentioned color developer of formula (1) is used together with a binder resin having hydroxyl group in its molecule, the preservation stability can be further improved.

The leuco dye, color developer, and binder resin are not limited to the respective examples as mentioned above.

The thermosensitive recording layer may further comprise any conventional fillers, pigments, surfactants, and thermofusible materials when necessary.

To provide the thermosensitive recording layer, for instance, a leuco dye and a color developer are uniformly dispersed or dissolved in water or an organic solvent, together with a binder resin, to prepare a coating liquid for thermosensitive recording layer. The thus prepared coating liquid is coated on the transparent support and dried, whereby a thermosensitive recording layer is provided on the support. In this case, the coating method is not particularly limited. For example, a die-fountain method or wire bar method may be employed. The die-fountain method is preferred to avoid coating defects.

When a dispersion where the leuco dye and the color developer are dispersed therein is used as the coating liquid for thermosensitive recording layer, it is preferable that the 50 percent volume mean diameter of the particles dispersed in the dispersion be controlled to 1.0 μm or less, more preferably 0.7 μm or less. This is because the particle size of the dispersed particles in the dispersion has a serious affect on the surface roughness of the protective layer provided on the recording layer, the transparency of the recording material, and the dot reproduction performance of the obtained image.

The amount of the binder resin contained in the thermosensitive recording layer is preferably 15 wt. % or more of the total weight of the solid content in view of transparency. More preferably, the binder resin may be contained in an amount of 25 to 60 wt. % of the total weight of the solid content in the recording layer when the adhesion to the support, preservation stability, and coloring performance are also taken into consideration. When the content of the binder resin is 25 wt. % or more, the decrease in preservability of the leuco dye components other than the black coloring leuco dye component can be minimized. The result is that the coloring performance of images, in particular, half-tone images can be maintained after storage. On the other hand, when the content of the binder resin is 60 wt. % or less, the leuco dye can exhibit excellent coloring performance as a whole. Therefore, the increase in thickness of the recording layer can be inhibited, so that the transparency of the recording material can be ensured.

The thickness of the thermosensitive recording layer, which depends upon the composition of the recording layer, is preferably in the range of about 10 to 50 μm for the sake of high transmission density and light shielding properties, more preferably in the range of about 15 to 25 μm for obtaining high transmission density with transparency being maintained.

The coating liquid for thermosensitive recording layer may further comprise various additives such as an oil and a surfactant, when necessary, for improving the coating characteristics and the recording properties.

The thermosensitive recording material of the present invention may further comprise a protective layer which is overlaid on the thermosensitive recording layer.

The protective layer consisting of a resin is ideal from the viewpoint of transparency of the thermosensitive recording material. However, since the surface smoothness of the protective layer made of a resin is too high, the sticking problem is easily caused. Further, when the protective layer has extremely high surface smoothness, there is a risk of dust on the recording material being dragged by the thermal head. This phenomenon is hereinafter referred to as dragging problem. In particular, when a plastic film is used as the transparent support, the surface smoothness of the recording material becomes higher than that of the recording material employing a sheet of paper as the support. Because of such a high surface smoothness, the head matching properties are readily lowered and the dragging problem is easily induced. Defective images and abnormal images resulting from the sticking problem and dragging problem are fatal to the image formation for medical purposes.

As means for preventing such a sticking problem and dragging problem from occurring, a filler is conventionally added to the protective layer. In the transparent thermosensitive recording material, however, there is a risk of the decrease in transparency when the filler is contained in the protective layer in such a conventional manner as employed in the reflection type thermosensitive recording material. In the present invention, the following two methods are recommendable to maintain the transparency of the recording material even though the filler is added to the protective layer.

[Method (1)]: To finely roughen the surface of the recording material by the addition of a filler in the form of minute particles to the protective layer.

It is preferable that a filler be contained in the protective layer in the form of minute particles with a 50 percent volume mean diameter of 0.1 to 0.7 μm. To select a proper filler is important in this case because some filler particles, even if those particles are minute, may unfavorably agglomerate depending upon the combination with the resin for use in the protective layer. The agglomerates of filler particles will consequently form considerable concave and convex portions on the surface of the protective layer, thereby lowering the transparency of the recording material. On the other hand, unless minute convex and concave portions are formed on the surface of the protective layer even by the addition of minute filler particles, the head matching properties cannot be improved.

The minute filler particles may be amply contained in the protective layer to such a degree that part of the minute particles are always present in the surface portion of the protective layer. It is preferable that the amount of minute filler particles for use in the protective layer be 30 wt. % or more of the total weight of the protective layer. Further, when the content of the minute filler particles is in the range of 50 to 70 wt. %, more preferable effects can be expected in terms of the heat resistance and the binding properties.

More specifically, the surface roughness of the protective layer as defined in Japanese Laid-Open Patent Application 10-181214 is preferable in the present invention. The disclosure of Japanese Laid-Open Patent Application 10-181214 is herein incorporated by reference.

[Method (2)]: To partially roughen the surface of the recording material by the addition of a small amount of filler in the form of relatively large particles to the protective layer.

According to the method (2), the surface of the protective layer is formed in such a configuration that part of the large filler particles stick out from the relatively flat surface of the protective layer comprising a resin as the main component. In this case, it is preferable that the filler particles protrude from the surface by about 2 to 4 μm in view of the dot reproducibility of images formed on the surface of the recording material. From the viewpoint of transparency, it is preferable that the amount of relatively large filler particles for use in the protective layer be 30 wt. % or less, and more preferably in the range of 10 to 20 wt. % of the total weight of the protective layer.

Further, the above-mentioned methods (1) and (2) may be appropriately combined when the protective layer is provided on the thermosensitive recording layer.

It is preferable that the coefficient of friction of the protective layer be in the range of 0.07 to 0.14 when consideration is given to both aspects, that is, increase in lubricating properties to improve the head matching properties, and decrease in lubricating properties to prevent the dragging problem.

Examples of the filler for use in the protective layer include inorganic fillers such as phosphate fiber, potassium titanate, needle-like magnesium hydroxide, whisker, talc, mica, glass flake, calcium carbonate, calcium carbonate in the form of plates, aluminum hydroxide, aluminum hydroxide in the form of plates. silica, clay, kaolin, calcined clay, and hydrotalcite; and organic fillers such as crosslinked polystyrene resin powder, urea—formalin copolymer powder, silicone resin powder, crosslinked poly(methyl methacrylate) resin powder, guanamine—formaldehyde copolymer powder, and melamine—formaldehyde copolymer powder. In the present invention, the organic fillers are preferred because abrasion of a thermal head can be avoided. When the minute filler particle are used for the protective layer by the above-mentioned method (1), silica, aluminum hydroxide, kaolin, calcium carbonate, and melamine—formaldehyde copolymer powder, for example, a commercially available product "Epostar S" (trademark), made by Nippon Shokubai Co., Ltd., are effectively used. When the above-mentioned method (2) is used, guanamine—formaldehyde copolymer powder and silicone resin powder are preferred.

As the resin for use in the protective layer, the same water-soluble resin as in the formation of the thermosensitive recording layer may be used alone, or in combination with an aqueous emulsion, a hydrophobic resin, an ultraviolet curing resin, and an electron-beam curing resin when necessary. From the viewpoint of transparency, it is preferable to determine the resin material for use in the thermosensitive recording layer or the protective layer so that the ratio of the refractive index of each resin material for use in the recording layer or the protective layer to that of the transparent support may be in the range of 0.8 to 1.2 as mentioned above.

Specific examples of the resins for use in the protective layer are polyacrylate resin, polymethacrylate resin, polyurethane resin, polyester resin, poly(vinyl acetate) resin, styrene acrylate resin, polyolefin resin, polystryrene resin, poly(vinyl chloride) resin, polyether resin, polyamide resin, polycarbonate resin, polyethylene resin, polypropylene resin, and polyacrylamide resin.

A crosslinking agent may be used in combination with the resin for the formation of the protective layer. In this case, conventional crosslinking agents such as isocyanate compounds and epoxy compounds are usable.

Specific examples of the isocyanate compounds having two or more isocyanate groups in a molecule thereof are toluylenediisocyanate, dimers thereof, dephenylmethane diisocyanate, polymethylene polyphenylisocyanate, hexamethylene diisocyanate, polyisocyanate, and derivatives of those compounds.

Specific examples of the epoxy compounds are ethylene glycol diglycidyl ether, butyl glycidyl ether, polyethylene glycol diglycidyl ether, and epoxy acrylate.

To further improve the head matching properties of the recording material with the thermal head, the protective layer may further comprise a variety of waxes and oils.

Specific examples of the waxes are stearamide, palmitamide, oleamide, lauramide, ethylenebisstearamide, methylenebisstearamide, methylolstearamide, paraffin wax, polyethylene, carnauba wax, paraffin oxide, and zinc stearate.

As the oils for use in the protective layer, there can be employed general-purposed silicone oils.

In addition, the coefficient of friction of the protective layer can be adjusted to enhance the head matching properties by employing a binder resin comprising a silicone-modified resin, and controlling the ratio of the resin to the filler for use in the protective layer.

The coating method for the formation of the protective layer is not particularly limited. The protective layer can be provided by any conventional coating methods such as wire bar coating method or die-foundation method. It is preferable that the thickness of the protective layer be in the range of 0.1 to 20 $\mu$m, more preferably in the range of 0.5 to 10 $\mu$m. When the thickness of the protective layer is within the above-mentioned range, the functions as the protective layer to improve the preservation stability and the head matching properties of the recording material can be satisfactorily attained. At the same time, a decrease in thermal sensitivity of the recording material can be effectively prevented, and a rise in the manufacturing cost can be restrained.

The transparent thermosensitive recording material of the present invention may further comprise an intermediate layer to improve the surface smoothness of each layer, which intermediate layer may be interposed between the transparent support and the thermosensitive recording layer, or between the thermosensitive recording layer and the protective layer. The intermediate layer may comprise a pigment, a binder resin, and a thermofusible material.

The transparent thermosensitive recording material of the present invention is a plastic film, so that there is a risk of dust electrostatically adhering to the surface of the recording material.

To impart the antistatic properties to the thermosensitive recording material, it is effective to provide a backcoat layer on the support, opposite to the thermosensitive recording layer with respect to the support Any conventional electron conduction type materials and ion conduction type materials may be used as the materials for the backcoat layer as long as the backcoat layer can appear transparent. It is preferable that the surface resistivity of the backcoat layer be $1\times10^{10}\Omega/m^2$ or less in light of the function to prevent the dust from electrostatically adhering to the recording material.

Further, the backcoat layer for use in the present invention may be provided with the functions to reduce curling of the recording material, and to control the transporting properties of the recording material. In addition, the backcoat layer may further comprise a matting agent so as to have a silver salt film appearance. To obtain such a silver salt film appearance, any conventional materials may be contained in the backcoat layer as long as the transparency of the transparent thermosensitive recording material can be ensured.

The transparent thermosensitive recording material of the present invention is prepared in the form of a sheet or roll in practice for setting in a printer for medical applications. When the sheet-shaped recording material is employed, it is preferable that the thermosensitive recording material have the same thickness as that of a silver salt film, more specifically, a total thickness of 170 to 250 $\mu$m.

With respect to the roll-shaped thermosensitive recording material, it is preferable that the total thickness of the thermosensitive recording material be in the range of about 100 to 140 $\mu$m in view of the length of the roll sheet, and the curling tendency. Furthermore, it is preferable that the roll of the thermosensitive recording material have a Gurley stiffness of 190 to 250 mgf when measured in the rolling direction of the thermosensitive recording material.

The thermosensitive recording material prepared into a sheet or roll may be hermetically sealed in a bag with moisture-proof properties and/or light shielding properties. By sealing the recording material in such a bag, yellowing of the background of the recording material can be prevented, and the coloring performance of the recording material can be maintained.

Examples of the materials with moisture-proof properties are polyethylene, polypropylene, vinyl chloride, polyethylene—polyvinyl alcohol copolymer, and polyester.

A vinyl bag deposited with metals such as aluminum, titanium, and chromium, and metallic oxides, or a vinyl bag colored with, for example, carbon black may be used as the bag with light shielding properties. Those materials may be used in combination when necessary, for example, by laminating. When the bag is prepared by laminating a plurality of films, each containing the above-mentioned materials, it is not preferable to dispose an aluminum-deposited vinyl film at the outermost and innermost position in the laminated film bag. This is because the aluminum-deposited vinyl film is susceptible to friction, so that the obtained bag is not provided with desired characteristics.

A film disposed at the outermost position may comprise a variety of conventional fillers or may be subjected to chemical treating by, for example, corona charge, to improve the acceptability of printing ink Further, to prevent the blocking problem of the bag during the storage of the recording material, the outermost surface of the bag may be subjected to matte finish by the addition of large filler particles, or subjected to embossed finish.

The opening of the bag may be hermetically heat-sealed or sealed with an adhesive tape or clip. In particular, heat-sealing is most preferably to ensure the sealed condition.

The roll-shaped thermosensitive recording material is advantageous because the recording apparatus can be made compact. In this case, however, when a plastic film is used as the transparent support, the roll tends to become unwound before image recording because the stiffness of the plastic film is stronger than that of a sheet of paper.

For preventing the rolled recording material from being released, it is preferable that the roll of the recording material be provided with a member for preventing the roll from becoming unwound. For example, at least one stopper may be attached to each of both ends of the rolled thermosensitive recording material.

Figure 3:
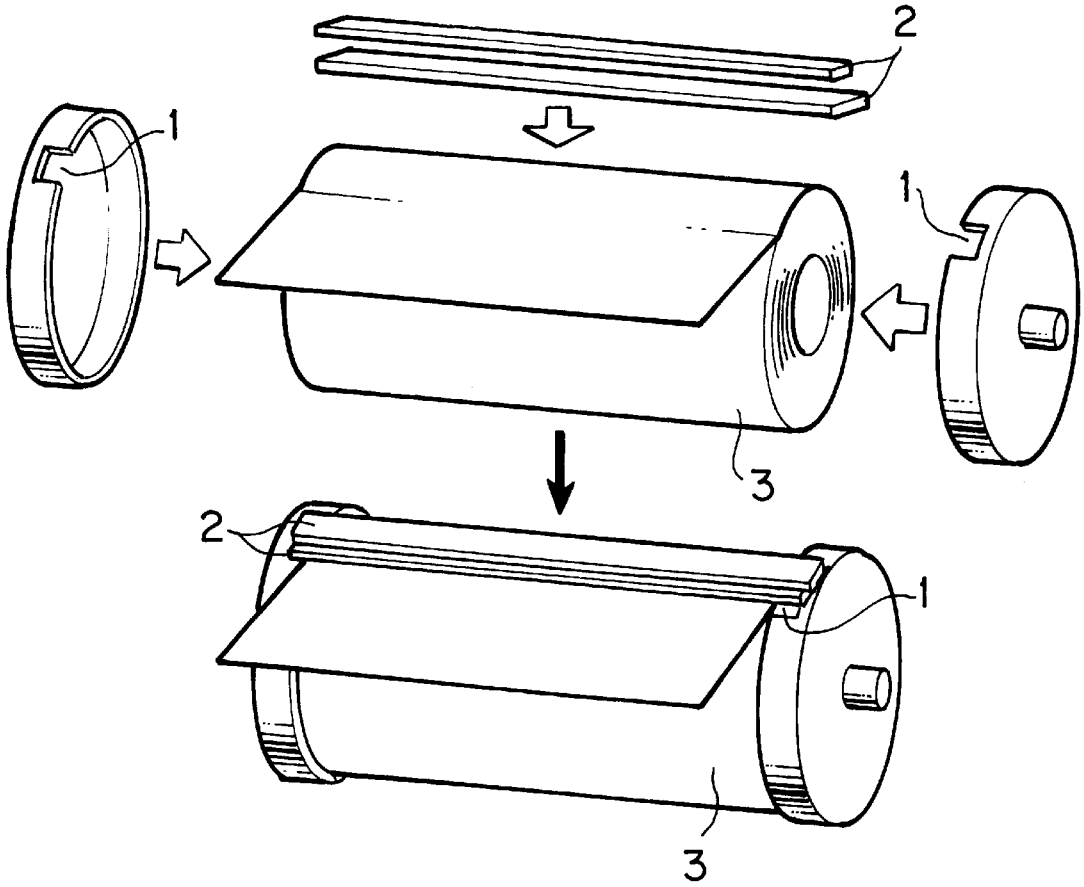
FIG. 3 is an exploded view in perspective of a rolled transparent thermosensitive recording material of the present invention, illustrating additional parts which may be attached to the recording material as they appear during assembly thereof.

FIG. 3 is an exploded view in perspective of a rolled thermosensitive recording material of the present invention, illustrating additional parts which may be attached to the recording material as they appear during assembly thereof.

In FIG. 3, stoppers 1 are attached to both ends of a rolled thermosensitive recording material 3. Furthermore, in this embodiment, the rolled thermosensitive recording material 3 is provided with a dust cleaning pad 2. More specifically, the dust cleaning pad 2, which may be in a plate- or rod-shaped, is designed to extend between the stoppers 1 so as to remove dust from the surface of the recording material 3 while the recording material 3 is drawn out. By providing the roll of the recording material with a member for removing dust from the surface of the recording material, it is possible to prevent the occurrence of defective images which are regarded as fatal faults for a medical image, that is, partial omission in the image portion and a black stripe on the background portion.

The method of recording images in the transparent thermosensitive recording material is not particularly limited. For example, a thermal pen, thermal head, and laser beams may be employed. When consideration is given to the cost of recording apparatus, output speed, and compactness of the apparatus, the thermal head is the most preferable recording means in the present invention.

Other features of this invention will become apparent in the course of the following description of exemplary embodiments, which are given for illustration of the invention and are not intended to be limiting thereof.

EXAMPLE 1

Formation of Thermosensitive Recording Layer

Preparation of recording layer coating liquid

The following components were pulverized and dispersed in a ball mill until the 50 percent volume mean diameter of the color developer reached 0.7 μm, so that a recording layer coating liquid was prepared. The dye components (a), (b) and (c) were dissolved in the obtained coating liquid. The 50 percent volume mean diameter was measured using a commercially available laser scattering particle size distribution analyzer "LA-700" (Trademark), made by HORIBA, Ltd.

[Recording layer coating liquid]

| | Parts by Weight |
|---|---|
| Mixture of dye components (a), (b) and (c) [Note] | 4 |
| Octadecylphosphonic acid | 12 |
| Poly(vinyl butyral) (Trademark "Denka Butyral #3000-2", made by Denki Kagaku Kogyo Kabushiki Kaisha) | 2 |
| Poly(vinyl acetoacetal) (Trademark "S-Lec KS-1", made by Sekisui Chemical Co., Ltd.) | 6 |
| Blue dye (Trademark "Macrolex Blue 3R", made by Bayer Ltd.) | 0.1 |
| Toluene | 83 |
| Methyl ethyl ketone | 83 |

[Note] The dye components (a), (b), and (c) respectively represent as follows:
Dye component (a): 2-anilino-3-methyl-6-diethylaminofluoran
Dye component (b): 3-diethylamino-7,8-benzofluoran
Dye component (c): 6-diethylamino-2-ethylbenzo [1,4]-thiazino [3,2-b] fluoran The aforementioned dye components (a), (b) and (c) were mixed at a ratio by weight of 0.750:0.175:0.075, as shown in TABLE 1.

The above prepared recording layer coating liquid was coated on a 175 -μm thick transparent polyethylene terephthalate film "HMW" (Trademark), made by Teijin Limited, by die-fountain method, and dried at about 60° C. in a drying chamber, whereby a thermosensitive recording layer with a thickness of 16 μm was provided on the transparent film. The haze of the polyethylene terephthalate film was 5%.

Formation of Protective Layer

The following components were pulverized and dispersed in a ball mill until the 50 percent volume mean diameter of dispersed particles reached 0.19 μm, so that a filler dispersion No. 1 was prepared.

[Filler dispersion No. 1]

| | Parts by Weight |
|---|---|
| Melamine-formaldehyde copolymer particles (Trademark "EPOSTAR S", made by Nippon Shokubai Co., Ltd.) | 30 |
| 10% methyl ethyl ketone solution of poly(vinyl acetoacetal) (Trademark "S-Lec KS-1", made by Sekisui Chemical Co., Ltd.) | 30 |
| Methyl ethyl ketone | 140 |

The following components were pulverized and dispersed in a ball mill until the 50 percent volume mean diameter of dispersed particles reached 0.60 μm, so that a filler dispersion No. 2 was prepared.

[Filler dispersion No. 2]

| | Parts by Weight |
|---|---|
| Zinc stearate | 30 |
| 10% methyl ethyl ketone solution of poly(vinyl acetoacetal) (Trademark "S-Lec KS-1", made by Sekisui Chemical Co., Ltd.) | 30 |
| Methyl ethyl ketone | 140 |

Thereafter, 100 parts by weight of the filler dispersion No. 1, 13 parts by weight of the filler dispersion No. 2, 83 parts by weight of 10% methyl ethyl ketone solution of poly(vinyl acetoacetal) (Trademark "S-Lec KS-1", made by Sekisui Chemical Co., Ltd.), and 74 parts by weight of methyl ethyl ketone were mixed and sufficiently stirred, whereby a protective layer coating liquid was prepared.

The above prepared protective layer coating liquid was coated on the thermosensitive recording layer by die-fountain method and dried at 60° C., whereby a protective layer with a thickness of 3 μm on a dry basis was provided on the thermosensitive recording layer.

Thus, a transparent thermosensitive recording material No. 1 according to the present invention was obtained after allowed to stand at 50° C. and 30% RH for 4 days for aging process.

EXAMPLE 2

The procedure for preparation of the transparent thermosensitive recording material No. 1 in Example 1 was repeated except that the ratio by weight of the dye components (a), (b), and (c) constituting the mixture of dye components for use in the formulation for the recording layer coating liquid in Example 1 was changed as shown in TABLE 1

Thus, a transparent thermosensitive recording material No. 2 according to the present invention was obtained.

EXAMPLE 3

The procedure for preparation of the transparent thermosensitive recording material No. 1 in Example 1 was repeated except that the ratio by weight of the dye components (a), (b), and (c) constituting the mixture of dye components for use in the formulation for the recording layer coating liquid in Example 1 was changed as shown in TABLE 1.

Thus, a transparent thermosensitive recording material No. 3 according to the present invention was obtained.

EXAMPLE 4

The procedure for preparation of the transparent thermosensitive recording material No. 2 in Example 2 was repeated except that the blue dye ("Macrolex Blue 3R") for use in the formulation for the recording layer coating liquid in Example 2 was removed from the formulation therefor.

Thus, a transparent thermosensitive recording material No. 4 according to the present invention was obtained.

EXAMPLE 5

The procedure for preparation of the transparent thermosensitive recording material No. 3 in Example 3 was repeated except that the amount of poly(vinyl acetoacetal) for use in the formulation for the recording layer coating liquid in Example 3 was changed from 6 to 2 parts by weight, and that the thickness of the thermosensitive recording layer was changed from 16 to 13 μm.

Thus, a transparent thermosensitive recording material No. 5 according to the present invention was obtained.

EXAMPLE 6

The procedure for preparation of the transparent thermosensitive recording material No. 3 in Example 3 was repeated except that the amount of poly(vinyl acetoacetal) for use in the formulation for the recording layer coating liquid in Example 3 was changed from 6 to 28 parts by weight, and that the thickness of the thermosensitive recording layer was changed from 16 to 35 μm.

Thus, a transparent thermosensitive recording material No. 6 according to the present invention was obtained.

COMPARATIVE EXAMPLE 1

The procedure for preparation of the transparent thermosensitive recording material No. 1 in Example 1 was repeated except that the thickness of the thermosensitive recording layer was changed from 16 to 14 μm.

Thus, a comparative transparent thermosensitive recording material No. 1 was obtained.

COMPARATIVE EXAMPLE 2

The procedure for preparation of the transparent thermosensitive recording material No. 2 in Example 2 was repeated except that the thickness of the thermosensitive recording layer was changed from 16 to 14 μm.

Thus, a comparative transparent thermosensitive recording material No. 2 was obtained.

COMPARATIVE EXAMPLE 3

The procedure for preparation of the transparent thermosensitive recording material No. 3 in Example 3 was repeated except that the thickness of the thermosensitive recording layer was changed from 16 to 14 μm.

Thus, a comparative transparent thermosensitive recording material No. 3 was obtained.

COMPARATIVE EXAMPLE 4

The procedure for preparation of the transparent thermosensitive recording material No. 1 in Example 1 was repeated except that the ratio by weight of the dye components (a), (b), and (c) constituting the mixture of dye components for use in the formulation for the recording layer coating liquid in Example 1 was changed as shown in TABLE 1, and that the thickness of the thermosensitive recording layer was changed from 16 to 18 μm.

Thus, a comparative transparent thermosensitive recording material No. 4 was obtained.

COMPARATIVE EXAMPLE 5

The procedure for preparation of the comparative transparent thermosensitive recording material No. 4 in Comparative Example 4 was repeated except that the thickness of the thermosensitive recording layer was changed from 18 to 14 μm.

Thus, a comparative transparent thermosensitive recording material No. 5 was obtained.

COMPARATIVE EXAMPLE 6

The procedure for preparation of the transparent thermosensitive recording material No. 1 in Example 1 was repeated except that the ratio by weight of the dye components (a), (b), and (c) constituting the mixture of dye components for use in the formulation for the recording layer coating liquid in Example 1 was changed as shown in TABLE 1.

Thus, a comparative transparent thermosensitive recording material No. 6 was obtained.

COMPARATIVE EXAMPLE 7

The procedure for preparation of the comparative transparent thermosensitive recording material No. 6 in Comparative Example 6 was repeated except that the thickness of the thermosensitive recording layer was changed from 16 to 14 μm.

Thus, a comparative transparent thermosensitive recording material No. 7 was obtained.

COMPARATIVE EXAMPLE 8

The procedure for preparation of the transparent thermosensitive recording material No. 1 in Example 1 was repeated except that the ratio by weight of the dye components (a), (b), and (c) constituting the mixture of dye components for use in the formulation for the recording layer coating liquid in Example 1 was changed as shown in TABLE 1.

Thus, a comparative transparent thermosensitive recording material No. 8 was obtained.

COMPARATIVE EXAMPLE 9

Formation of Thermosensitive Recording Layer

Preparation of recording layer coating liquid

A mixture of the following components was separately pulverized and dispersed in a ball mill until the 50 percent volume mean diameter of each dispersion reached 0.7 μm, so that a dye dispersion, a color developer dispersion, and a filler dispersion were prepared. The dye components (a) and (b) were mixed at a ratio by weight of (0.850):(0.150) and dissolved in the dye dispersion.

| | Parts by Weight |
|---|---|
| [Dye Dispersion] | |
| Mixture of dye components (a) and (b) | 20 |
| 10% aqueous solution of poly(vinyl alcohol) | 20 |
| Water | 60 |
| [Color Developer Dispersion] | |
| 4-isopropoxy-4'-hydroxydiphenyl sulfone | 20 |
| 10% aqueous solution of poly(vinyl alcohol) | 25 |
| Water | 50 |
| [Filler Dispersion] | |
| Silica | 20 |
| 10% acqueous solution of methyl cellulose | 20 |
| Water | 60 |

15 parts by weight of the dye dispersion, 45 parts by weight of the color developer dispersion, 45 parts by weight of the filler dispersion, and 5 parts by weight of a 20% alkaline aqueous solution of isobutylene—maleic anhydride copolymer were mixed and sufficiently stirred, whereby a recording layer coating liquid was prepared.

The above prepared recording layer coating liquid was coated on the same transparent film as in Example 1 and dried in the same manner as in Example 1, whereby a thermosensitive recording layer with a thickness of 14 μm on a dry basis was provided on the transparent film.

Thereafter, a protective layer was provided on the thermosensitive recording layer in the same manner as in Example 1.

Thus, a comparative transparent thermosensitive recording material No. 9 was obtained.

TABLE 1

| | Ratio by Weight of Dye Components | | | Thickness of Recording Layer |
|---|---|---|---|---|
| | (a) | (b) | (c) | (μm) |
| Ex. 1 | 0.750 | 0.175 | 0.075 | 16 |
| Ex. 2 | 0.700 | 0.200 | 0.100 | 16 |
| Ex. 3 | 0.625 | 0.225 | 0.150 | 16 |
| Ex. 4 | 0.700 | 0.200 | 0.100 | 16 |
| Ex. 5 | 0.625 | 0.225 | 0.150 | 13 |
| Ex. 6 | 0.625 | 0.225 | 0.150 | 35 |
| Comp. Ex. 1 | 0.750 | 0.175 | 0.075 | 14 |
| Comp. Ex. 2 | 0.700 | 0.200 | 0.100 | 14 |
| Comp. Ex. 3 | 0.625 | 0.225 | 0.150 | 14 |
| Comp. Ex. 4 | 0.450 | 0.300 | 0.250 | 18 |
| Comp. Ex. 5 | 0.450 | 0.300 | 0.250 | 14 |
| Comp. Ex. 6 | 0.815 | 0.185 | 0 | 16 |
| Comp. Ex. 7 | 0.815 | 0.185 | 0 | 14 |
| Comp. Ex. 8 | 1.000 | 0 | 0 | 16 |
| Comp. Ex. 9 | 0.850 | 0.150 | 0 | 14 |

Each of the transparent thermosensitive recording materials obtained in Examples 1 to 6 and Comparative Examples 1 to 9 was cut into sample pieces to evaluate the following properties.

1. Transparency in terms of haze

The haze of each sample film was measured using a commercially available haze meter made by Suga Test Instruments Co., Ltd in accordance with JIS K7105. The results are shown in TABLE 2.

2. Transmission density, absorbance, and color space

Images were formed in each sample film using a digital printer until transmission density was saturated. The commercially available measuring instrument "Spectroscan T" was provided with "Spectrolino", both made by Gretag Macbeth Co., Ltd., and the measurement was carried out using the standard illuminant $D_{65}$ of diffuse/specular (d/0) light under the conditions that the aperture diameter was set at 3 mm, the standard observer was set at 10°, and the physical resolution was set at 10 nm.

The measuring items are as follows:

(a) The transmission density of the image was measured when the saturated transmission density was obtained. The results are shown in TABLE 2 as the maximum transmission density.

(b) The absorbance of an image with a maximum transmission density was measured at the wavelength of 610 nm. The results are shown in TABLE 2.

(c) The ratio of the absorbance at 700 nm to the absorbance at 610 nm was obtained within the region from a transmission density of 1.0 to the maximum transmission density. The maximum value obtained within this region is shown in TABLE 2.

(d) The perceived color of the image with a transmission density of 1.5 was expressed by L*a*b* color space. The values of a* and b* are shown in TABLE 2.

3. Evaluation of recording material for medical use (1) Light-shielding properties A gray scale pattern image was formed in each recording material using a digital printer. Each of the image-bearing recording material was placed on a commercially available Moriyama X-ray film viewer "LT-2K" (Trademark) equipped with a 3 wavelengths daylight fluorescent lamp "FL15EX-D" (Trademark) made by Matsushita Electric Industrial Co., Ltd., which exhibited such a spectrum of Schaukasten 1 as shown in FIG. 2. With an OHP sheet carrying black character images thereon being interposed between the image-bearing transparent thermosensitive recording material and the film viewer, it was observed whether the black character images on the OHP sheet were visible via the image portion with a maximum transmission density formed in the transparent thermosensitive recording material. The light shielding properties of each recording material were evaluated on the following scale:

○: The black character images were not visible, and the light shielding properties were evaluated as excellent.

Δ: The black character images were slightly visible.

X: The black character image were clearly visible.

(2) Color tone

The perceived color of the images with a transmission density of 1.0 to 2.0 formed in the recording material was organoleptically evaluated.

(3) Image quality for medical diagnosis

A medical image was printed on each recording material using a digital printer. The medical image was viewed through the above-mentioned film viewer to organoleptically evaluate the image quality for diagnosis on the following scale:

◎: The contrast was sufficient and the medical image was clear enough to be read very easily.

○: The contrast was sufficient and the medical image was clear enough to be read.

Δ: It was slightly difficult to read the medical image because of insufficient contrast or unclearness of image.

X: It was difficult to read the medical image because of insufficient contrast and unclearness of image.

(4) Preservation stability of image

A gray scale pattern image was formed in each recording material using a digital printer. Each image-bearing recording material was stored for 100 hours at 60° C. under dry atmosphere, or at 40° C. and 90% RH. After the storage, the image remaining percentage (%) was calculated in accordance with the following formula.

The image remaining percentage varied depending upon the transmission density of the image. The maximum value of the image remaining percentage is given in TABLE 2.

All the evaluation results are shown in TABLE 2.

TABLE 2

| | | | | | | | Evaluation of Properties as Recording Material for Medical Use | | | | |
|---|---|---|---|---|---|---|---|---|---|---|---|
| | Haze (%) | Maximum Transmission Density | Absorbance of Image at 610 nm (*) | Ratio of A to B (**) | L*a*b* Color Space a* | b* | Light-shielding properties | Color tone | Image quality for diagnosis | Preservation Stability of Image (%) 60° C. Dry | 40° C. 90% RH |
| Ex. 1 | 25 | 2.55 | 3.15 | 0.13 | 2.78 | −2.8E | ○ | Black | ○ | −10 | 5 |
| Ex. 2 | 26 | 2.62 | 3.23 | 0.18 | 1.90 | −3.94 | ○ | Black | ◎ | −13 | 3 |
| Ex. 3 | 24 | 2.73 | 3.31 | 0.25 | 1.25 | −4.53 | ○ | Black | ◎ | −13 | −2 |
| Ex. 4 | 23 | 2.54 | 3.15 | 0.18 | 1.6 | 2:3 | ○ | Black | ○ | −12 | 2 |
| Ex. 5 | 25 | 2.51 | 3.10 | 0.23 | 1.22 | −4.48 | ○ | Black | ◎ | −24 | −B |
| Ex. 6 | 35 | 2.43 | 3.05 | 0.24 | 1.28 | −4.48 | ○ | Black | ◎ | −15 | −6 |
| Comp. Ex. 1 | 26 | 2.33 | 2.83 | 0.13 | 2.75 | 2.83 | Δ | Black | Δ | −11 | |
| Comp. Ex. 2 | 28 | 2.25 | 2.76 | 0.18 | 1.95 | −3.91 | X | Black | Δ | −12 | 3 |
| Comp. Ex. 3 | 25 | 2.30 | 2.80 | 0.25 | 1.23 | −4.51 | X | Black | Δ | −16 | −4 |
| Comp. Ex. 4 | 23 | 2.5B | 3.05 | 0.32 | 2.3 | −3.3B | ○ | Black | Δ | −28 | −16 |
| Comp. Ex. 5 | 22 | 2.20 | 2.53 | 0.33 | 2.28 | −3.35 | X | Black | X | −27 | −15 |
| Comp. Ex. 6 | 24 | 2.21 | 3.18 | 0.08 | 10.66 | −2.3 | X | Red-tinged black | X | −10 | 3 |
| Comp. Ex. 7 | 21 | −1.88 | 2.81 | 0.08 | 10.66 | −2.26 | X | Red-tinged black | X | −11 | 1 |

TABLE 2-continued

| | Haze (%) | Maximum Transmission Density | Absorbance of Image at 610 nm (*) | Ratio of A to B (**) | L*a*b* Color Space a* | L*a*b* Color Space b* | Light-shielding properties | Color tone | Image quality for diagnosis | Preservation Stability of Image (%) 60° C. Dry | Preservation Stability of Image (%) 40° C. 90% RH |
|---|---|---|---|---|---|---|---|---|---|---|---|
| | Evaluation of Properties as Recording Material for Medical Use | | | | | | | | | | |
| Comp. Ex. 8 | 23 | 2.31 | 3.13 | 0.07 | −3.5 | 6.3 | Δ | Green tinged black | X | −8 | 3 |
| Comp. Ex. 9 | 65 | 1.68 | 2.6 | 0.06 | 6.53 | 3.53 | X | Red-tinged black | X | −40 | −55 |

(*) The image with a maximum transmission density was subjected to measurement.
(**) A represents the absorbance at 700 nm, and B represents the absorbance at 610 nm.

As described above, the transparent thermosensitive recording material according to the present invention is suitable for medical applications. Images formed in the transparent thermosensitive recording material are excellent in terms of light-shielding properties, coloring performance, and preservation stability when viewed on a film viewer (Schaukasten).

Japanese Patent Applications No. 11-292991 filed Oct. 14, 1999 and No. 2000-295599 filed Sep. 28, 2000 are hereby incorporated by reference.

What is claimed is:

1. A transparent thermosensitive recording material capable of producing an image therein, comprising a transparent support and a thermosensitive recording layer formed thereon comprising a colorless or light-colored leuco dye, a color developer capable of inducing coloring formation in said leuco dye, and a binder resin, wherein said image exhibits an absorbance of 3.0 or more at 610 nm when said image has a maximum transmission density, and the ratio of the absorbance at 700 nm to the absorbance at 610 nm is in a range of 0.1 to 0.3 within the region from a transmission density of said image of 1.0 to said maximum transmission density thereof.

2. The transparent thermosensitive recording material as claimed in claim 1, wherein said binder resin is contained in said thermosensitive recording layer in an amount of 25 to 60 wt. % of the entire weight of solid content for use in said thermosensitive recording layer.

3. The transparent thermosensitive recording material as claimed in claim 1, further comprising a protective layer which is provided on said thermosensitive recording layer.

4. The transparent thermosensitive recording material as claimed in claim 1, wherein said color developer comprises an organic phosphonic acid compound of formula (1):

(1)

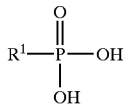

wherein $R^1$ is a straight-chain alkyl group having 12 to 28 carbon atoms.

5. The transparent thermosensitive recording material as claimed in claim 1, wherein said leuco dye comprises at least a leuco dye component capable of producing a black color, a leuco dye component exhibiting a maximum absorption peak within a range of 400 to 580 nm, and a leuco dye component exhibiting a maximum absorption peak within a range of 630 to 750 nm.

6. The transparent thermosensitive recording material as claimed in claim 5, wherein said leuco dye component exhibiting a maximum absorption peak within a range of 630 to 750 nm is represented by formula (2):

(2)

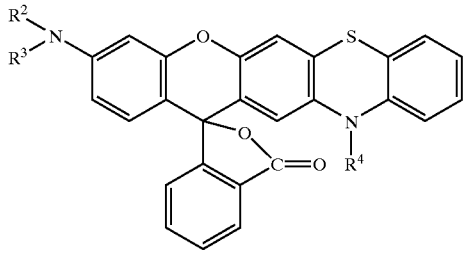

wherein $R^2$ and $R^3$ are each independently a straight-chain or branched alkyl group having 1 to 6 carbon atoms, an alkoxyalkyl group having 2 to 6 carbon atoms, a cycloalkyl group having 5 or 6 carbon atoms, allyl group, or

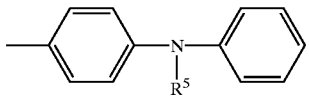

in which $R^5$ is an alkyl group having 1 to 5 carbon atoms, and $R^2$ and $R^3$ may form a 5- or 6-membered heterocyclic ring in combination; and $R^4$ is a hydrogen atom, or a straight-chain or branched alkyl group having 1 to 12 carbon atoms.

7. The transparent thermosensitive recording material as claimed in claim 6, wherein said color developer comprises an organic phosphonic acid compound of formula (1):

(1)

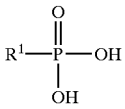

wherein $R^1$ is a straight-chain alkyl group having 12 to 28 carbon atoms.

8. The transparent thermosensitive recording material as claimed in claim 5, wherein said leuco dye component capable of producing a black color is contained in an amount of 60 wt. % or more of the total weight of said leuco dye.

9. The transparent thermosensitive recording material as claimed in claim 1, wherein said color developer is contained in an amount of 1 to 20 parts by weight to one part by weight of said leuco dye.

10. The transparent thermosensitive recording material as claimed in claim 1, wherein said transparent support is a polyethylene terephthalate film.

11. The transparent thermosensitive recording material as claimed in claim 1, wherein said transparent thermosensitive recording material is blue-colored.

12. The transparent thermosensitive recording material as claimed in claim 1, prepared in the form of a sheet.

13. The transparent thermosensitive recording material as claimed in claim 12, having a total thickness of 170 to 250 $\mu$m.

14. The transparent thermosensitive recording material as claimed in claim 12, wherein said thermosensitive recording material is hermetically sealed in a bag with light shielding properties or moisture-proof properties.

15. The transparent thermosensitive recording material as claimed in claim 1, prepared in the form of a roll.

16. The transparent thermosensitive recording material as claimed in claim 15, wherein said thermosensitive recording layer has a total thickness of 100 to 140 $\mu$m.

17. The transparent thermosensitive recording material as claimed in claim 15, wherein said roll of said thermosensitive recording material has a Gurley stiffness of 190 to 250 mgf when measured in the rolling direction of said thermosensitive recording material.

18. The transparent thermosensitive recording material as claimed in claim 15, wherein said roll of said thermosensitive recording material is provided with a member for preventing said roll from becoming unwound.

19. The transparent thermosensitive recording material as claimed in claim 15, wherein said roll of said thermosensitive recording material is provided with a member for removing dust from the surface of said thermosensitive recording material.

20. The transparent thermosensitive recording material as claimed in claim 15, wherein said thermosensitive recording material is hermetically sealed in a bag with light shielding properties or moisture-proof properties.

* * * * *